United States Patent [19]

Kurushima et al.

[11] 4,319,751

[45] Mar. 16, 1982

[54] HAMMER GAME

[75] Inventors: Minoru Kurushima; Akio Esaka, both of Tokyo, Japan

[73] Assignee: Epoch Company, Ltd., Tokyo, Japan

[21] Appl. No.: 150,678

[22] Filed: May 16, 1980

[51] Int. Cl.[3] ..... A63F 9/14; A63H 13/06

[52] U.S. Cl. ..... 273/85 E; 46/142; 46/148

[58] Field of Search ..... 46/142, 148; 273/1 G, 273/85 R, 85 C, 1 R, 85 E, 85 F

[56] References Cited

U.S. PATENT DOCUMENTS 2,269,095 1/1942 Davis ..... 46/142

3,856,304 12/1974 Matsumoto et al. ..... 46/142

*Primary Examiner*—George J. Marlo

*Attorney, Agent, or Firm*—Staas & Halsey

[57] ABSTRACT

A competitive amusement game apparatus in which a player selectively moves a playing member pivotally mounted on a base housing toward an opposing playing member in an effort to strike the head of the opposing playing member. Each of the playing members includes a pair of arms pivotally connected to a body and having a head releasably attached to and positioned on the body. A shield is connected to the outer end of one of the arms and a hammer is connected to the outer end of the other of the arms for each of the playing members. The hammer of one playing member will strike the head of the opposing playing member to disengage the head of that playing member if the shield of the opposing playing member is not in position in front of the head. If the shield of the opposing playing member is in position, a hammer when moved toward it will simply srike that shield and not reach the head of the opposing playing member. A normally-operable actuating mechanism is operatively connected to each of the playing members for selectively pivoting the arms of each of the playing members for moving the shield of the playing member downwardly and the hammer of the same playing member toward the other opposing playing member for hitting, and thereby releasing the head from the body of the opposing playing member.

13 Claims, 4 Drawing Figures

HAMMER GAME

Figure 1:
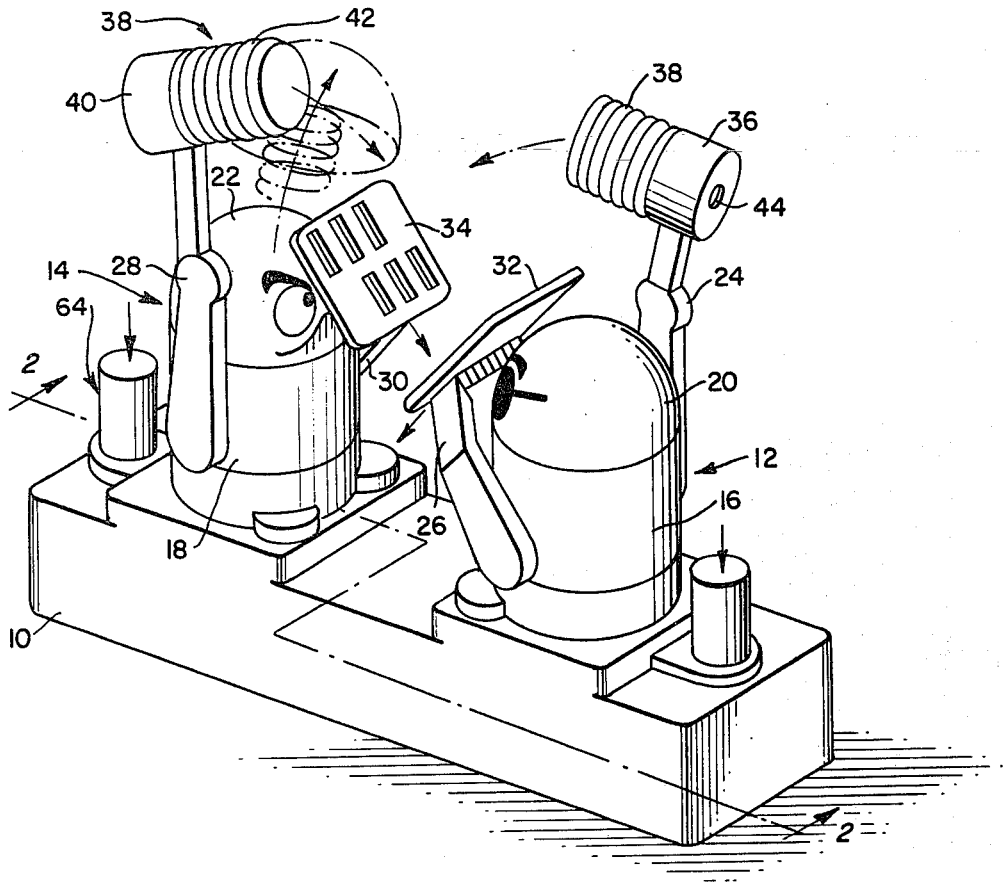

This invention relates to an amusement game apparatus and, more particularly, to a competitive amusement game apparatus in which a player selectively moves a playing member pivotally mounted on a base structure toward an opposing playing member in an effort to hit the opposing playing member's head.

In accordance with one aspect of the invention, there is provided an amusement game apparatus comprising: a base housing; two playing members mounted on the base housing opposing each other, each of the playing members having a body fixed to the base housing, a head releasably attached to and positioned on the body, a pair of arms pivotally connected to the body and normally biased to an upwardly-extended position, shield means connected at the outer end of one of the arms and hammer means connected at the outer end of the other of the arms; and, manually-operable actuating means operatively connected to each of the playing members for selectively pivoting the arms of each of the playing members for moving the shield means of the playing member downwardly and the hammer means of the same playing member toward the other opposing playing member for hitting and thereby releasing the head from the body of the opposing playing member.

In a preferred embodiment, the amusement game apparatus further comprises magnet and spring means for releasably attaching and positioing the head on the body of each of the playing members. The magnet and spring means includes for each playing member a spring attached at one end to the inside of the head and the other end to the inside of the body, a first magnet mounted on the inside of the head, and a second magnet mounted on the inside of the body for engagement with the first magnet to position the head on the body. The first and second magnets disengage from each other by the force of the hammer means of the opposing playing member hitting the head with the spring means urging the head away from the body upon disengagement. The hammer means for each playing member preferably comprises a hammer base attached to one of the arms and a hammer head formed of a flexible bellows fixedly attached at one end to the hammer base. Whistle means can be positioned inside the hammer base and activated for producing a noise when the hammer head flexible bellows retracts and forces air from inside the bellows through a hole formed in the hammer base. The bellows is retractable when the hammer head hits the shield means of the opposing playing member.

It is an object of this invention to provide a game apparatus which is amusing and entertaining, which is durable and simple in construction to provide a reliable game apparatus and to ensure the safety of the users, and one which has components easily assembled and simple in construction to allow a low-cost, high-volume production.

Additional objects and advantages of the invention will be set forth in part in the description which follows, and in part will be obvious from the description, or may be learned by practise of the invention.

The accompanying drawings, which are incorporated in and constitute a part of the specification, illustrate an embodiment of the invention and, together with the description, serve to explain the principles of the invention.

Figure 2:
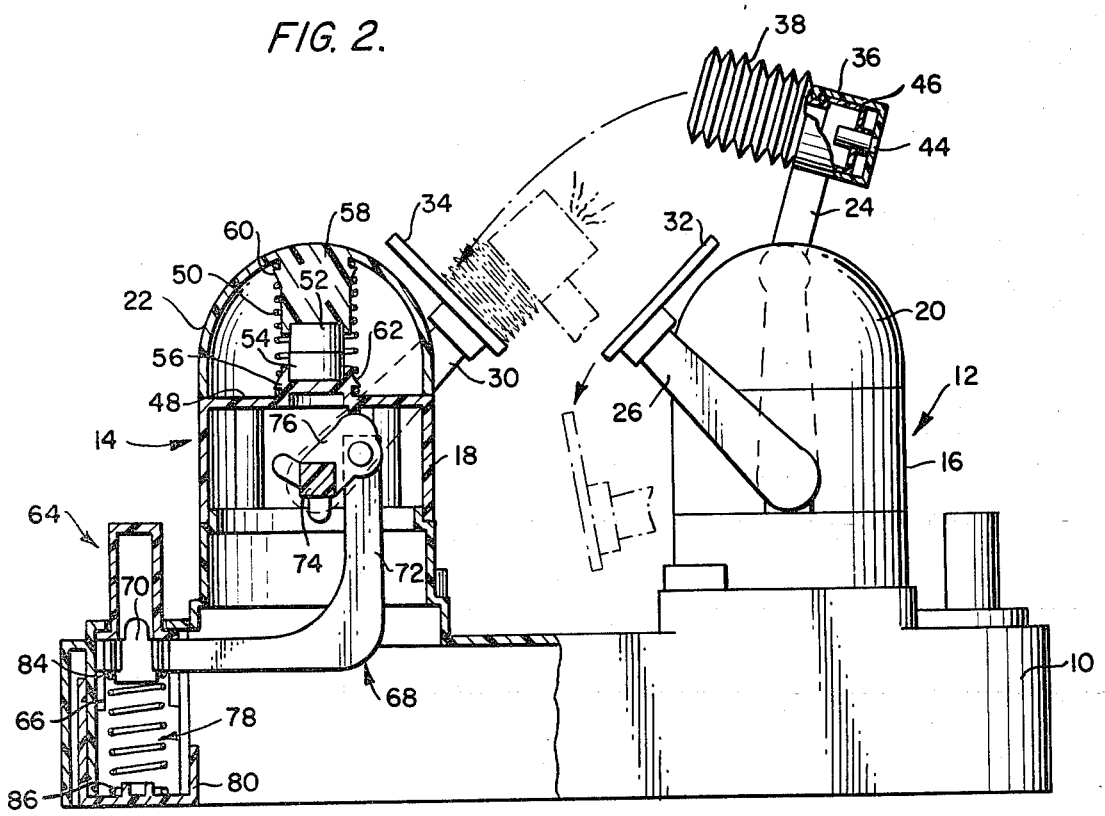
Figure 3:
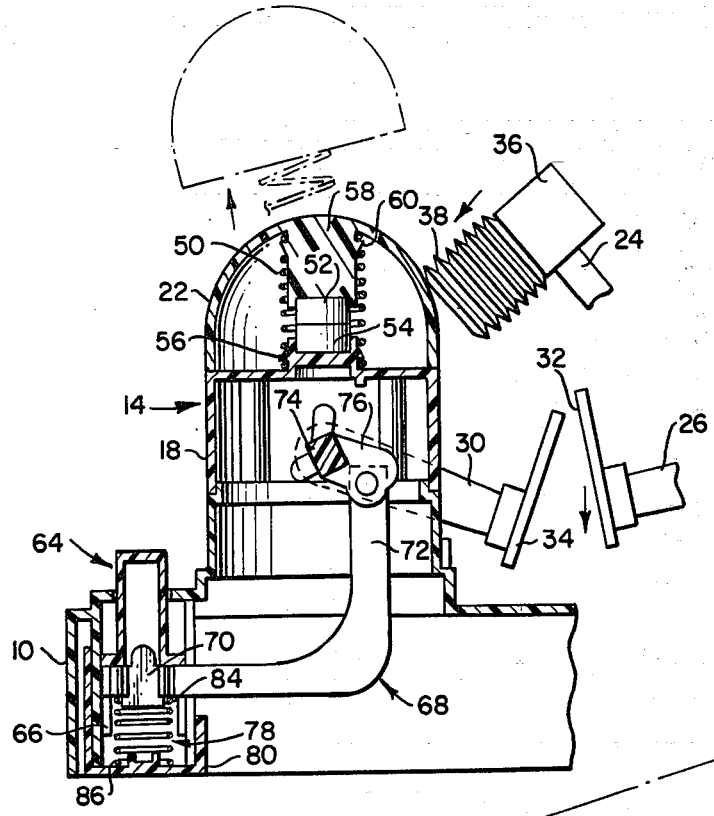
Figure 4:
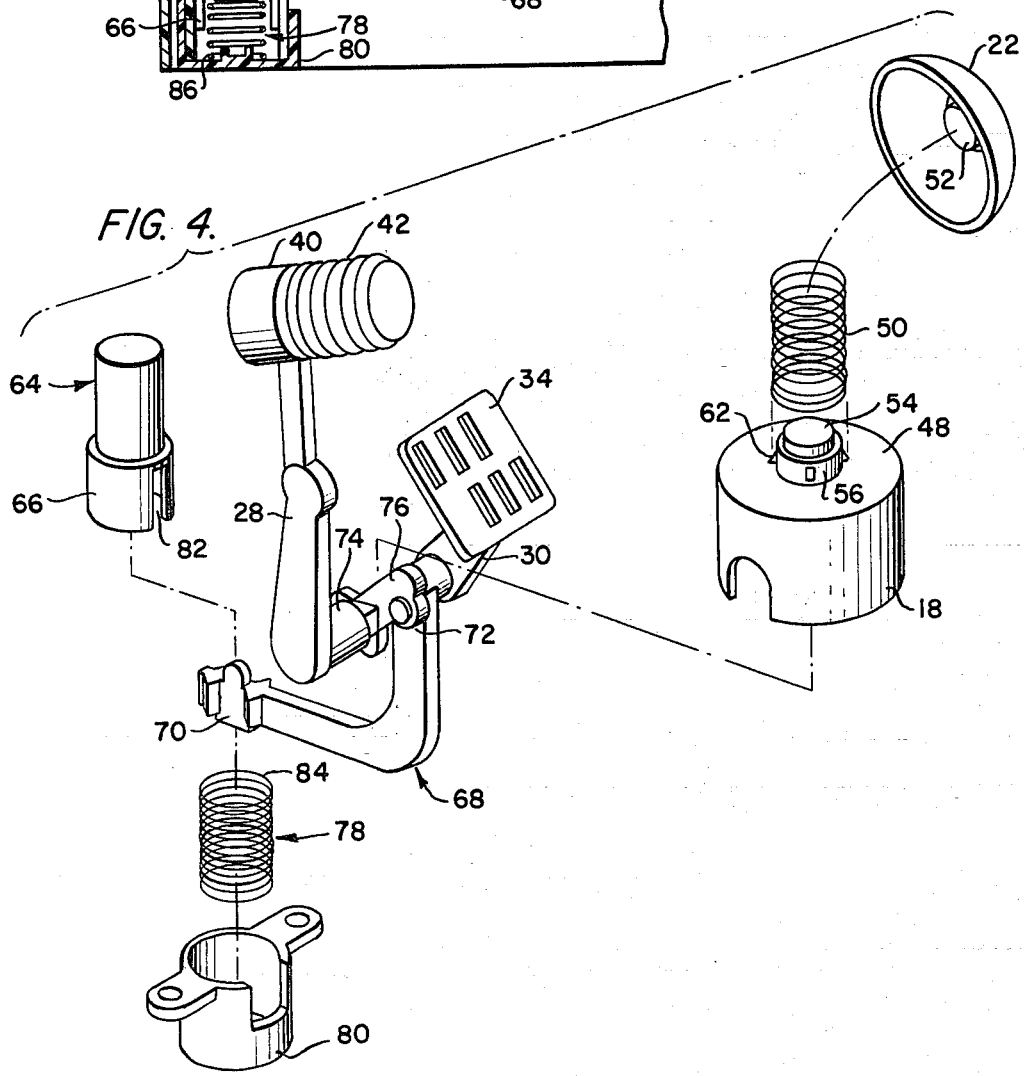

FIG. 1 is a perspective view of a preferred embodiment of the amusement game apparatus in accordance with the invention, illustrating the possible directional movement of the hammer means and shield means of each of the playing members and the releasable position of the head of one of the playing members upon disengagement from the body of that playing member;

FIG. 2 is a partially fragmented side view of the amusement game apparatus of FIG. 1 taken along line 2—2, illustrating in particular the pivoting movement of the arms of one of the playing members while the opposing playing member's arms remain stationary with the pivoting hammer means engaging the stationary shield means of the opposing playing member and the pivoting shield means moving downwardly away from the head as the hammer means is moved against the shield means of the opposing playing member;

FIG. 3 is a partial cross-sectional view of the amusement game apparatus of FIG. 1, illustrating in particular the engagement of the hammer means of one of the playing members against the head of the opposing playing member to disengage the head from the body when the arms of both playing members are pivoted with the shield means being moved downwardly away from the heads of both playing members; and, FIG. 4 is an exploded perspective view of various elements of the amusement game apparatus, illustrating in particular the components of the manually-operable actuating means, the cooperation of the actuating means with the pivotal arms of one of the playing members having the hammer means and shield means connected thereon, and the association of the components of the spring and magnet means with the head and body of the playing member.

Reference will now be made in detail to the present preferred embodiment of the invention, an example of which is illustrated in the accompanying drawings.

In accordance with the invention and as shown in FIG. 1, the game apparatus includes a base housing 10 and two playing members, generally designated with the reference numerals 12 and 14, which are mounted on the base housing 10 opposing each other. As herein embodied, each of the playing members include a body fixed to the base housing, a head releasably attached to and positioned on the body, a pair of arms pivotally connected to the body and normally biased to an upwardly-extended position. As best seen in FIG. 1, playing member 12 has a body 16 affixed to base housing 10, head 20 releasably attached to and positioned on body 16, and arms 24 and 26 pivotally connected to body 16 and biased in an upwardly-extended position. In similar manner, playing member 12 has body 18, head 22, and arms 28 and 30.

In accordance with the invention, each of the two playing members of the game apparatus further comprises shield means connected at the outer end of one of the arms and hammer means connected at the outer end of the other of the arms.

As herein embodied, each shield means comprises a flat shield connected to the arm in such a manner that the shield is positioned in the front of the head of the playing member when the arms are normally biased to the upwardly-extended position. As best seen in FIG. 1, the playing member 12 has a flat shield 32 connected to the outer end of arm 26 positioned in front of the head 20 of that playing member when the arms 24 and 26 are normally biased in their upwardly-extended position. In similar manner, the playing member 14 has a flat shield 34 connected to the outer end of the arm 30 so that it is positioned in front of the head 22 of that playing member when the arms 28 and 30 are normally biased in their upwardly-extended position. The position of the flat shields 32 and 34 can also be seen in FIG. 2 when they are in their normally biased upwardly-extended position.

As herein embodied, and as best seen in FIG. 1, the hammer means of each playing member comprises a hammer base attached to the arm of the playing member and a hammer head formed of a flexible bellows fixably attached at one end to the hammer base. The hammer means is connected to the arm in such a manner that the hammer is positioned above the head of the playing member when the arms are normally biased to the upwardly-extended position. For the playing member 12 illustrated, the hammer means includes a hammer base 36 attached to the arm 24 of that playing member and a hammer head 38 formed of a flexible bellows fixably attached at one end to the hammer base 36. This hammer base 36 and hammer head 38 are connected to the arm 24 in such a manner that they are positioned above the playing member 12 in the normally-biased upwardly-extending position and movable toward the opposing playing member 14 when the arms 24 and 26 of the playing member 12 are pivoted. In a similar manner, the hammer means for playing member 14 includes a hammer base 40 connected to the end of the arm 28 and a hammer head 42 formed of a flexible bellows fixably attached at one end to the hammer base 40. This hammer base 40 and hammer head 42 are attached to the arm 28 in such a manner that they are positioned above the playing member 14 in the normally-biased upwardly-extended position and movable toward the opposing playing member 12 when the arms 28 and 30 of the playing member 14 are pivoted.

As embodied herein and illustrated, the hammer head flexible bellows for each playing member is retractable when the hammer head hits the shield means of the opposing playing member. As will be described in greater detail hereinafter, the hammer head will hit the shield means of the opposing playing member when the arms of that opposing playing member are not pivoted. For example, and as shown in FIG. 2, when the arms 24 and 26 of the playing member 12 are pivoted, the hammer head 38 and hammer base 36 connected to the arm 24 are moved toward the opposing playing member 14. If, as illustrated in FIG. 2, the arm 28 and 30 of the opposing playing member 14 are not pivoted, the shield 34 of that playing member will remain stationary in front of the head 22 so that the hammer head 38 of the playing member 14 when it is moved downwardly will hit shield 34. In doing so, the flexible bellows of the hammer head will retract upon engagement.

As herein embodied, the flexible bellows of the hammer head for each of the playing members can be attached to the respective hammer base in such a manner to form an air chamber within the hammer means. A hole may be formed through the hammer base of each playing member. The game apparatus may further comprise whistle means positioned inside the hammer base and activated for producing a noise when the hammer head flexible bellows retracts and forces air from inside the bellows through the hole of the hammer base. As illustrated in FIGS. 1 and 2, the hammer base 36 of playing member 14 has a hole 44 formed therethrough at the end opposite the flexible bellows of the hammer head 38. The whistle means for the playing member 12 can comprise a whistle 46 inserted inside the hammer base 36 so that the flow of air through the whistle 46 and the hole 44 when the flexible bellows of the hammer head 38 retracts will cause the production of a noise. As explained previously and as illustrated in FIG. 2, the whistling noise can be achieved when the hammer head 38 strikes the shield 34 of the opposite playing member 14. To ensure an adequate striking of the flexible bellows 38 against the flat shield 34, the hammer head bellows 38 has a flat closed end for engagement with the shield. In a similar fashion, the hammer base 40 for the playing member 14 can be provided with a similar hole and whistle means for producing a noise when the hammer head 42 and hammer base 40 of the playing member 14 are moved downwardly to strike the opposing shield 32 of playing member 12. Again, the hammer head 42 of the playing member 14 will only strike shield 32 when the arms 24 and 26 of that playing member 12 are not pivoted. To achieve this intercooperation between the hammer and shield means of the two playing members, the shield means of each playing member is oppositely disposed from the hammer means of the opposing playing member. Accordingly, as shown in FIG. 1, the shield 32 of playing member 12 is oppositely disposed in directional movement to the hammer head 42 of the playing member 14 and the shield 34 of the playing member 14 is oppositely disposed in directional movement to the hammer head 38 of playing member 12.

In the preferred embodiment of the game apparatus in accordance with the invention, the body of each playing member has a top surface on which is positioned the respective head. Thus, as illustrated in FIGS. 2, 3 and 4, the body 18 of the playing member 14 has a level top surface 48 on which is positioned head 22. In like manner, the body 16 of the playing member 12 has a level top surface for positioning of head 20 thereon. Preferably, the head of each playing member has a dome-shaped configuration with the body of each playing member having a cylindrical configuration. The dome-shaped head rests on the top of the cylindrical-shaped body in such a manner to form an integral playing member. While it is of course possible to provide different configurations for the heads and bodies of each playing member, it was found that the dome-shaped head, along with the cylindrical body, provides a configuration to the playing members which is amusing and entertaining to the players and which very suitably allows for the releasable attachment and positioning of the head on the body. Obviously, the head of each of the playing members can have designed thereon a particular face as illustrated in FIG. 1.

To releasably attach and position the head on the body of each of the playing members, the game apparatus further comprises magnet and spring means. The magnet and spring means for each player comprises a spring attached at one end to the inside of the head and the other end to the inside of the body, a first magnet mounted on the inside of the head, and a second magnet mounted on the inside of the body for engagement of the first magnet to position the head on the body.

In the preferred embodiment illustrated in the drawings, the playing member 14 has a spring 50 attached at one end to the inside of the head 22 and the other end to the top surface 48 of body 18. A first magnet 52 is mounted on the inside of the head 22 while a second magnet 54 is mounted on the top surface 48 of the body 18 for engagement with the first magnet 52 to position the head 22 on the body 18. To mount the spring 50 and magnets 52 and 54 to the head and body of the playing member 14, there is provided a first mounting ring member 56 integrally formed in the center on the top surface 48 of the body 18 and a second mounting ring member integrally formed in the center on the inner surface of the head 22.

Preferably, and as illustrated in FIGS. 2, 3 and 4, one end of the spring 50 is attached to the outer portion of the first ring member 56 and the other end of the spring is attached to the outer portion of the second ring mounting member 58. The first magnet 52 is mounted in the ring member 56 and the second magnet 54 is mounted in the mounting ring member 58 opposite to the first magnet 52 with both magnets 52 and 54 being positioned inside the spring 50. Projections 60 and 62 may be formed respectively on the outer perimeters of the first and second mounting ring members 56 and 58 for lockingly-engaging the corresponding ends of the spring 50 to the ring members. While not illustrated in the drawings, the playing member 12 is provided with a similar arrangement of magnet and spring means as described above for playing member 14. Accordingly, no further description of that structure for playing member 12 is necessary.

It can be seen from the foregoing that the magnet and spring means provides a unique releasable attachment and positioning of the head on the body for each of the playing members. As will now be described in detail below, the two magnets for each of the playing members that are engaged to hold the head on the body can become disengaged from each other by the force of the hammer means of the opposing playing member hitting the head. When this disengagement occurs, the spring means urges the head away from the body. This is best seen with reference to FIG. 3. By way of illustration, when the arms 28 and 30 of the playing member 14 are pivoted down from their normally biased, upwardly-extended position, the shield 34 of the playing member 14 is moved downwardly from in front of the head 22 of that playing member. If the arms 28 and 30 of the opposing playing member 12 are also pivoted simultaneously from their normally biased, upwardly-extended position, the hammer head 38 of the playing member 12 will move toward the head 22 of the playing member 14. When this occurs, the hammer head 38 can strike the head 22 of the playing member 14 to cause the magnets 52 and 54 inside the head 22 and body 18 to disengage. Accordingly, the head 22 will be released from the body 18 of the playing member 14 by the biasing of the spring 50 against the head 22, thus causing the head to move away from the body as illustrated in FIGS. 1 and 3.

It can be seen from the foregoing description of the playing members and the cooperation between the hammer means and shield means of each of the playing members that the amusement and entertainment of this game apparatus occurs by the selective manipulation and operation of the pivotable arms for the playing members 12 and 14. As previously discussed, if the arms of one playing member are not pivoted, then the shield means remains in front of the head of that playing member. Thus, if the hammer means of the opposing playing member is moved downwardly at the same time, it will not strike the head of the other playing member, but instead will strike the shield means of the other playing member. It is only when the arms of a playing member are pivoted to move the hammer means that the shield of that playing member is also moved downwardly to expose the releasably attached head of the playing member to the striking blows of the hammer means of the opposing playing member.

In accordance with the invention and to achieve the selective manipulation of the playing members, the game apparatus further comprises manually-operable actuating means operatively connected to each of the playing members for selectively pivoting the arms of each of the playing members for moving the shield means of the playing member downwardly and the hammer means of the same playing member toward the other opposing playing member for hitting the thereby releasing the head from the body of the opposing playing member. As herein embodied, the actuating means comprises a pair of independently and manually-operable push-buttons extending from the base housing, with each button having a portion extending downwardly into the housing, and a pair of levers at least partially positioned inside the base housing and the playing members, each lever having a first end connected to a respective one of the push-buttons and the second end respectively connected to the arms of a respective one of the playing members for pivoting the arms in response to manual movement of the push-button.

In the preferred embodiment as illustrated in the drawings, playing member 14 has a push-button 64 extending from the base housing 10 which is manually-operable by a game player and which is mounted on the base housing adjacent the playing member 14 to which that button 64 is connected. The button 64 has a portion 66 which is slidably received and extends downwardly into the base housing 10. A lever 68 is positioned inside the base housing and has one end 70 connected to the push-button 64 and the other end 72 connected to the arms of the playing member 14 for pivoting the arms in response to manual movement of the push-button 64. Preferably, the playing member 14 has an axle 74 which is rotatably mounted on and extends through the body 18. The arms 28 and 30 of the playing member 14 are attached to the ends of this rotatable axle 74. This axle 74 includes a lever portion 76 which extends transversely outwardly therefrom to which is connected the second end 72 of the actuating lever 68.

As herein embodied, the actuating means for the playing member 14 further comprises a spring 78 mounted in the base housing 10 for engaging the first end 70 of the actuating lever 68 and the push-button portion 66 extending into the base housing 10 for biasing the push-button 64 and the arms 28 and 30 of the playing member 14 to the upwardly-extended position. A cup-like hollow mounting member 80 is mounted to the inside of the base housing 10 for positioning and receiving the actuating spring 78 below the push-button portion 66. Preferably, the push-button portion 66 is formed with a receiving slot 82 for receiving the first end 70 of the actuating lever 68 therein. In this configuration, the actuating spring 78 would have an upward end 84 positioned against the first end 70 of the actuating lever 68 for biasing the lever end 70 and the push-button 64 upwardly. The actuating lever 68 would be formed in a right-angle configuration and would have its second end 72 pivotally connected at point 86 to the lever portion 76, of the rotatably mounted axle 74 for urging the arms 28 and 30 of the playing member 14 attached to the axle 74 to their normally-biased, upwardly-extended position.

While the actuating means has been described only with respect to the playing member 14, the other playing member 12 can be selectively manipulated by actuating means that is operatively connected to that playing member 12 and which has the same configuration and components as those previously described for playing member 14. Accordingly, it is not necessary to further describe the construction and operation of the actuating means for playing member 12.

In view of the foregoing written description of the preferred embodiment and accompanying drawings, it is seen that there is provided a game apparatus which is both amusing, entertaining and competitive for the players by selectively manipulating the arms of the respective playing members in an attempt to protect one's own playing member as well as to strike the opposing playing member. The objective of the game is to disengage the head of the opposing playing member by striking that head with the hammer means of the player's own playing member. However, because of the movement of the shield away from the head of a playing member when the arms are pivoted, a player must be careful to protect his playing member from having his head disengaged while offensively trying to strike the head of the opposing playing member. Of course, when the hammer does strike the head of an opposing playing member, the arrangement of the spring and magnet means is such to provide a unique releasable connection of the head to the body and to allow the head to be repositioned back onto the body of a playing member very readily by simply moving the head onto the body with the magnets reengaging themselves to hold the head onto the body. It is further seen that the game apparatus as illustrated is durable and simple in construction and in assembly to provide low-cost, high-volume production. It will be apparent to those skilled in the art that modifications and variations could be made in the game apparatus in accordance with the teachings of the invention without departing from the scope of the invention. Thus, it is intended that the present invention cover the modifications and variations of this invention within the scope of the claims and their equivalents.

We claim:

1. A game apparatus comprising:

(a) a base housing;

(b) two playing members mounted on the base housing opposing each other, each of the playing members having (i) a body fixed to the base housing, and having a top flat mounting surface, (ii) a head releasably attached to and positioned on the top surface of the body, (iii) magnet and spring means for releasably attaching to and positioning the head on the body comprising a spring attached at one end to the inside of the head and the other end to the inside of the body, a first magnet mounted on the inside of the body, and a second magnet mounted on the inside of the head for engagement with the first magnet to position the head on the body and wherein the spring urges the head away from the body upon disengagement of the first and second magnets, (iv) a pair of arms pivotally connected to the body and normally biased to an upwardly-extended position, (v) shield means connected at the outer end of one of the arms, and (vi) hammer means connected at the outer end of the other of the arms and oppositely disposed from the shield means of the opposite playing member, the hammer means comprising a hammer base attached to the arm and a hammer head formed of a flexible bellows fixedly attached at one end to the hammer base, the hammer head flexible bellows being retractable when the hammer head hits the shield means of the opposite playing member and wherein the hammer head hits the head of the opposing player for disengaging the magnets when the hammer means of that playing member is pivoted and the shield means of the opposing player member is pivoted downwardly; and (c) manually-operable actuating means operatively connected to each of the playing members for selectively pivoting the arms of each of the playing members for moving the shield means of the playing member downwardly and the hammer means of the same playing member toward the other opposing playing member for hitting and thereby releasing the head from the body of the opposing playing member.

2. The game apparatus of claim 1 further comprising for each playing member a first mounting ring member formed on the center of the top surface of the body and a second mounting ring member formed in the center of the inside surface of the head wherein the ends of the spring are attached respectively to the outer portions of the mounting ring members and the first and second magnets are mounted respectively in the mounting ring members and inside the spring.

3. The game apparatus of claim 2 further comprising projections formed on the outer perimeter of the first and second mounting ring members for lockingly-engaging the corresponding ends of the springs to the mounting rings.

4. The game apparatus of claim 1, wherein for each playing member the hammer head bellows has a flat closed outer end and the shield means comprises a flat shield mounted on the arm of the playing member to face the opposite playing member and to engage the flat outer end of the hammer head of the opposite playing member when the arms of the opposite playing member are provided.

5. A game apparatus comprising:

(a) a base housing;

(b) two playing members mounted on the base housing opposing each other, each of the playing members having (i) a body fixed to the base housing, and having a top flat mounting surface, (ii) a head releasably attached to and positioned on the top surface of the body, (iii) magnet and spring means for releasably attaching to and positioning the head on the body comprising a spring attached at one end to the inside of the head and the other end to the inside of the body, a first magnet mounted on the inside of the body, and a second magnet mounted on the inside of the head for engagement with the first magnet to position the head on the body and wherein the spring urges the head away from the body upon disengagement of the first and second magnets, (iv) a first mounting ring member formed on the center of the top surface of the body and a second mounting ring member formed in the center of the inside surface of the head wherein the ends of the spring are attached respectively to the outer portions of the mounting ring members and the first and second magnets are mounted respectively in the mounting ring members and inside the spring, (v) a pair of arms pivotally connected to the body and normally biased to an upwardly-extended position, (vi) shield means connected at the outer end of one of the arms, and (vii) hammer means connected at the outer end of the other of the arms and oppositely disposed from the shield means of the opposite playing member, the hammer means comprising a hammer base attached to the arm and a hammer head formed of a flexible bellows fixedly attached at one end to the hammer hase, the hammer head flexible bellows being retractable when the hammer head hits the shield means of the opposite playing member and wherein the hammer head hits the head of the opposing player for disengaging the magnets when the hammer means of that playing member is pivoted and the shield means of the opposing player member is pivoted downwardly; and, (c) manually-operable actuating means operatively connected to each of the playing members for selectively pivoting the arms of each of the playing members for moving the shield means of the playing member downwardly and the hammer means of the same player toward the opposing playing member for hitting and thereby releasing the head from the body of the opposing playing member.

6. The game apparatus of claim 1 or 5 wherein the actuating means comprises a pair of independently manually-operable push-buttons extending from the base housing, each button having a portion extending downwardly into the base housing, and a pair of levers positioned inside the base housing, each lever having a first end connected to a respective one of the push-buttons and the second end respectively connected to the arms of a respective one of the playing members for pivoting the arms in response to manual movement of the push-button.

7. The game apparatus of claim 6 wherein each push-button is mounted on the housing adjacent the playing member to which the button is connected and wherein the game apparatus further comprises a pair of axles, each axle being rotatably mounted on and extending through the body of a respective one of the playing members with the arms of the respective playing member being attached to the ends of the rotatable axle and wherein each axle has a lever portion extending transversely outwardly therefrom to which is connected the second end of a respective actuating lever and wherein the actuating means further comprises a spring mounted in the base housing and engaging the first end of the actuating lever and the portion of the button extending into the housing for biasing the push-button and arms of each of the playing members to the upwardly-extended position.

8. The game apparatus of claim 7 wherein the actuating means further comprises a pair of cup-like hollow mounting members, each mounting member being connected to the inside of the base housing for positioning and receiving the respective actuating spring below the portion of the push-button extending downwardly into the base housing and wherein the portion of the push-button extending into the base housing is formed with a receiving slot for receiving the first end of the actuating lever therein and wherein the spring has its upward end positioned against the first lever end for biasing the lever end and push-button upwardly and wherein each actuating lever is formed in a right-angle and has the second end pivotally connected to the lever portion of the corresponding arm axle for urging the pivotable arms of the playing member attached to the axle to the normally biased upwardly-extended position.

9. The game apparatus of claim 1, 2, 8, or 5, wherein the hammer base has a hole formed therethrough and wherein said game apparatus further comprises whistle means positioned inside the hammer base and activated for producing a noise when the hammer head flexible bellows retracts and forces air from inside the bellows through the hole of the hammer.

10. The game apparatus of claim 1, 4 or 5 wherein the head of each playing member has a dome-shaped configuration.

11. The game apparatus of claim 10 wherein the body of each playing member has a cylindrical configuration and the dome-shaped head rests on top of the cylindrical-shaped body.

12. The game apparatus of claim 10 wherein the hammer means hits the domed head of the opposing player when the hammer means of that playing member is pivoted and the shield means of the opposing playing member is pivoted downwardly.

13. The game apparatus of claim 1 or 5, wherein for each playing member the hammer means is positioned above the head and the shield means is positioned in front of the head when the arms are normally biased to the upwardly-extended position and wherein the shield means moves downwardly away from the head and the hammer means moves toward the head or shield means of the opposing playing member when the arms are pivoted.

* * * * *

UNITED STATES PATENT AND TRADEMARK OFFICE

CERTIFICATE OF CORRECTION

PATENT NO. : 4,319,751

DATED : March 16, 1982

INVENTOR(S) : Minoru Kurushima et al.

It is certified that error appears in the above—identified patent and that said Letters Patent is hereby corrected as shown below:

Front page, [57] Abstract, Column 2, line 15, "normally" should be --manually--.
Column 1, line 30, "positioing" should be --positioning--.
Column 6, line 13, "the" should be --and--.
Column 8, line 42, "provided" should be --pivoted--.
Column 9, line 9, "hase" should be --base--.

Signed and Sealed this

*Thirteenth* Day of *July 1982*

[SEAL]

*Attest:*

GERALD J. MOSSINGHOFF

*Attesting Officer*

*Commissioner of Patents and Trademarks*